US005411256A

United States Patent [19]

Savage

[11] Patent Number: 5,411,256

[45] Date of Patent: * May 2, 1995

[54] SLAPBALL HOCKEY GAME

[76] Inventor: Louis E. Savage, 280 Rector Pl., Apt. 4C, New York, N.Y. 10280

[ * ] Notice: The portion of the term of this patent subsequent to Jun. 29, 2010 has been disclaimed.

[21] Appl. No.: 67,714

[22] Filed: May 26, 1993

Related U.S. Application Data

[63] Continuation-in-part of Ser. No. 28,374, Mar. 9, 1993, Pat. No. 5,320,350, which is a continuation-in-part of Ser. No. 823,135, Jan. 21, 1992, Pat. No. 5,222,735.

[51] Int. Cl.[6] ..... A63F 7/06

[52] U.S. Cl. ..... 273/85 A; 273/85 F

[58] Field of Search ..... 273/85 R, 85 A, 85 B, 273/85 E, 85 F, 119 R, 119 A, 126 R, 129 V, 129 R, 129 T, 108

[56] References Cited

U.S. PATENT DOCUMENTS

| | | | |
|---|---|---|---|
| 1,122,141 | 12/1914 | McIlroy | 273/119 R |
| 1,608,447 | 11/1926 | Wade | 273/119 R |
| 1,806,071 | 5/1931 | Maass | 273/119 R |
| 2,048,944 | 7/1936 | Munro et al. | 273/85 A |
| 2,237,486 | 4/1941 | Henderson | 273/85 A |
| 3,815,911 | 6/1974 | Cooper | 273/85 A |
| 5,222,735 | 6/1993 | Savage | 273/85 A |

FOREIGN PATENT DOCUMENTS

| | | | |
|---|---|---|---|
| 454453 | 2/1949 | Canada | 273/85 A |
| 632798 | 12/1961 | Canada | 273/85 B |
| 361581 | 10/1922 | Germany | 273/85 E |

*Primary Examiner*—Sebastiano Passaniti

*Attorney, Agent, or Firm*—Schmeiser, Olsen & Watts

[57] ABSTRACT

An improved slapball hockey game comprising a branched bar for simultaneously moving a plurality of team players, including an off-side offensive player disposed behind an opponent's goal, a dual deflector for accurately redirecting a playing ball toward the mouth of an opponent's goal and a rotatable, multidirectional, height-adjustable serving mechanism for introducing a playing ball onto the surface of the game.

6 Claims, 7 Drawing Sheets

FIG. 5A
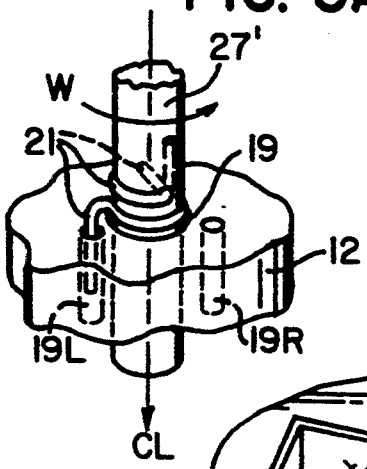
FIG. 5B
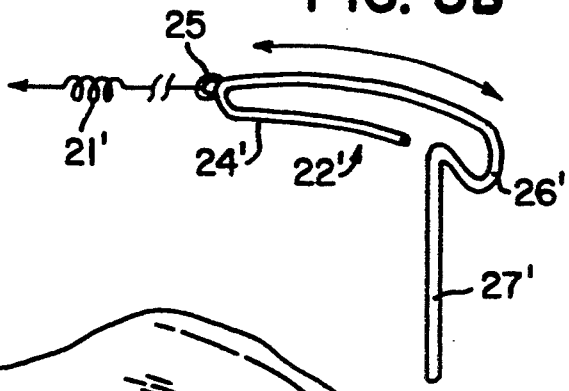
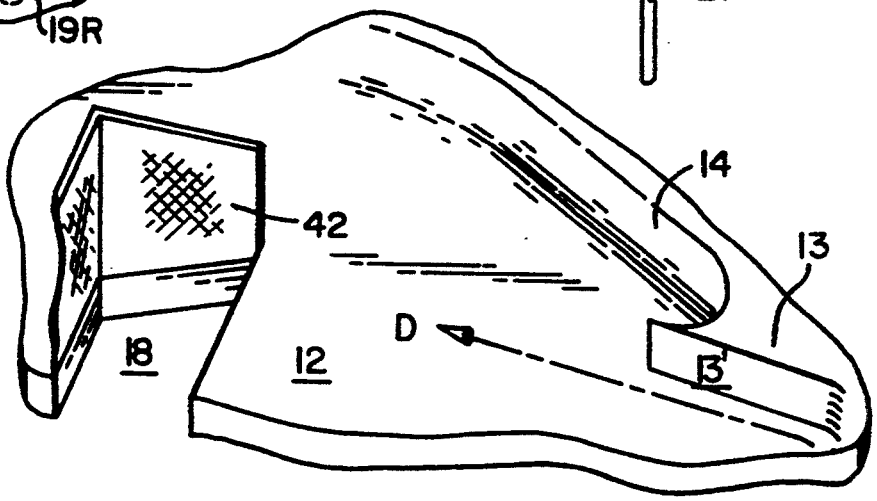
FIG. 6B
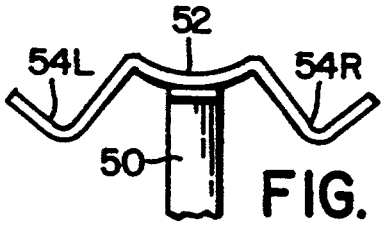
FIG. 7A
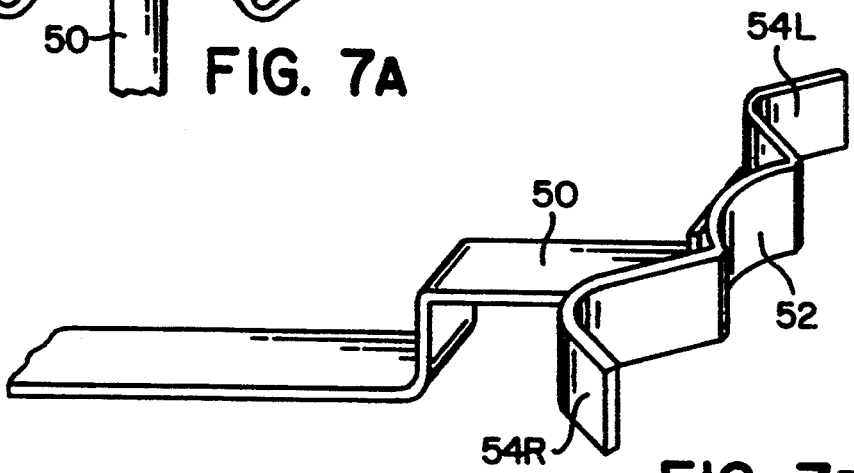
FIG. 7B

SLAPBALL HOCKEY GAME

This is a Continuation-in-Part of my U.S. application Ser. No. 08/028,374, filed on Mar. 9, 1993, now U.S. Pat. No. 5,320,350 entitled SLAPBALL HOCKEY GAME IMPROVEMENTS, which is a Continuation-in-Part of my U.S. application Ser. No. 07/823,135, filed on Jan. 21, 1992, now U.S. Pat. No. 5,222,735 entitled SLAPBALL HOCKEY GAME.

BACKGROUND OF THE INVENTION

1. Related Disclosures

This application is derived from U.S. Patent application Ser. No. 07/823,135 filed on Jan. 21, 1992 and incorporates that work by reference.

2. Field of the Invention

The present invention relates generally to the manufacture of table games and, more particularly, to the physical realization of a table game which simulates the playing conditions of ice hockey. Many incidents of the hereinafter disclosed improvements are emulative in nature and such nuances will be discussed as they are revealed.

3. Discussion of Relevant Art

The reader is referred to my original disclosure of the present invention, U.S. Patent application Ser. No. 823,135 wherein I detail the broader aspects of my invention. A relevant piece of art is U.S. Pat. No. 2,048,944 issued to D.H. Munro et al. on Jul. 28, 1936. Therein, Munro et al. disclose a unit player, of their table game, that consists of a wire rod bent so as to emulate a striking arm (or stick) of a player and which is bent so as to form, beneath the table, a lever arm having a hook at the end thereof. The purpose of the hook is to tie a control wire rod thereto, for the purposes of actuating or pivoting the device. In Canada, Pat. No. 456,453, issued Feb. 8, 1949, D.H. Munro teaches a table or board game similar to that of '944. Employing a multi-strand wire rod, he actuates the under-table lever arms of the various players causing them to pivot simultaneously on their journaling posts. As in '944, the players, i.e. the discrete pivoting units, are merely wire rods bent to effect a sweeping, striking arm. In both cases, the striking arm is cantilevered straight out from the journaled vertical post or axis of the unit. In both of the disclosures, the fundamental connection between the actuating lever, which is manipulated by the game operator, is wire rod tied to the discrete actuating lever ends which are then, in some cases, spring-biased to the table.

The Canada Patent, No. 632,798, issued to Kobayashi in 1961 discloses a board type hockey game consisting of a rectangular rink which is composed of a floor and surrounding wall with two teams of discrete rod-activated players that move in essentially downfield-upfield directions. Kobayashi employs separately operated goalie positions in which the playing unit consists of a singular bracket having a very shallow U-shape. Each player in this game, has a stick emulating portion of the player piece, including a cut out portion which imitates the natural space occurring between a true hockey player's stick and (skated) feet. Further, the rod actuators for moving the individual players in a general upfield-downfield motion comprise journaled shafts which actuate the player pieces to effect individual slapping or pivoting motions. The main distinction between the individual player unit activation of Kobayashi and that of Munro et al. is that the Kobayashi device requires a plurality of activator rods to control motions of the plurality of player units. This can be somewhat disadvantageous and, because of the myriad slots in the floor of the game, requires the use of a puck shaped playing device rather than a ball. Thus, the Munro et al. game is a much faster paced game. The distinct disadvantage in the Munro game, as well as others, is the plurality of wire or cord segments necessitated for the simultaneous actuation of player units by a single operating handle or lever.

Other relevant disclosures include patents issued to Cooper, U.S. Ser. No. 3,815,911 (1974) and Henderson, U.S. Ser. No. 2,237,486 (1941). Cooper employs triangularly shaped wall extensions which are meant to serve as additional obstacles to the object of play, which is a spinning top. These extensions, therefore, do not deflect a top with any calculated effect, but merely act as would any obstacle in the path of such a device. The patent issued to Henderson, on the other hand, discloses a wall incident that can be generally described as arcuate, changing to planar, the planar portion being orthogonal or perpendicular to a straight wall portion thereof. The arcuate portion of the aforementioned device is provided so that a sweeping arm or paddle may pass through the device's arc unobstructed and cooperatively therewith propel a ball or playing piece through the arcuate portion and away from the proximate goal. Thus, the obstacle or deflection modalities of both the Cooper and Henderson disclosures are precisely what they are seen to be, merely obstacles or devices which cooperate with another fixed part of the game (Henderson) in order to provide some game stratagem which appears to frustrate, rather than aid, scoring by an opposing (rather than a defending) player.

Before proceeding with a detailed description of the invention, I would like to define certain terms that will be employed throughout the remaining disclosure. The term "player" is used to define the game element that emulates a human hockey player. As to the human enthusiasts who play my slapball hockey game, they shall be referred to as "operators". An "emulator" or "emulation device" is a game device or unit that is designed to emulate a true hockey player or simulate, to some degree, some aspect of real hockey play. The term "board" refers to the playing surface and may be used interchangeably with "rink"; it being understood that, in lieu of "board", "table" may also be used. "Arcuate" shall mean any physical device or parameter that is curvate, curvilinear or sinuous. When I refer to devices or incidents of my game which have shapes in the configuration of a phonetic character, I mean of the general shape of a "W", "U" etc. and will use often therewith an adjective such as "shallow", "deep" etc. Specific motivative devices, such as a coil spring, may be referred to merely as "spring biasing"; the reader is given notice that any reasonable substitute for what is shown in the game, the figures or the claims may be inferred, such as a substitution of an elastomeric band for a coil spring. Finally, the term "defending" goal, etc. refers to a proximate location, where the ball is currently in play.

SUMMARY OF THE INVENTION

With my latest improvements, I have more closely emulated the game of ice hockey, taking considerable liberties with the use of adjunct mechanisms or designs to give the game operators a much higher degree of challenge and interest in the playing of Slapball Hockey.

One of these improvements consists in the change of a player unit slapping mechanism. I have reshaped the player unit so that two portions now extend oppositely, projecting in cantilever fashion from the vertical post portion of the device in order to emulate the hockey stick and the player's glove. The former of these is also alternately shaped sinuously or simply arcuately so that the portion at the distal end is in the shape of a shallow cup or U in order to releaseably capture or secure the playing ball. Extending in a (generally) opposite direction from the stick portion is the glove emulating portion which has a generally arcuate shape, again in order to releasably capture the ball. Further to the slapper portion, I have added an eyelet, or a tab, to the most distal upper portion of the stick emulator, a modification that will be explained later in this disclosure. In conjunction therewith, the player unit having such an eyelet modification will also have a vertical post, not unlike the original player units of my invention, but lack any underboard extensions from the post.

Another improvement resides in my new design for the goalie mechanism. In order to better imitate the true game player, I have reconfigured the releasable catchment portion of this unit. Where originally I taught a shallow V-shaped catchment, I now improve performance and emulation by the use of a shallow U cup design straddled by a pair of asymmetrical V shaped catchments. The central catchment emulates the stick-knee pad equipment of a goalie while the side V's emulate the gloves of which the true hockey goalie makes considerable use.

Yet, another improvement is a most important modification to the rink wall. Briefly, this is a curving and recurving of the rink wall first outwardly to a slight degree, say an arc of about 30–40 degrees up off the floor of the board, and then a recurve of from about 140° to 150° so as to effect a change in direction of a ball moving up the rink wall to at least 180°. Such an improvement has the distinct advantage over any of the prior art of presenting considerably heightened challenge to a defending operator. A playing object which no longer merely "bounces" off of the rink wall enlivens the game considerably more than would the addition of more versatile player units. An adjunct to the rink wall modification is a change in the shape of the goal cage (screen) from a generally rectangular enclosure to a V-shaped cage with the apex thereof positioned at the center of the former cage base (backstop) area. Now, if a ball were to slide up the rink wall, as modified, and be deflected toward the goalie cage, it would lose none of its impetus, but would be deflected definitely to the left or right of the cage. As with my first version of the game board, I still retain a slightly higher graded area behind the apex of the goalie cage in order to avoid the stalling of a ball in that region.

Another very important improvement is the elimination of cords or rods as activating devices in the form a spider array. The main disadvantage of a spider constructed of cords, rods or wires is that there is invariably some degree of slack in one or more of the connections; thus, actuation of the single controlling lever does not always command immediate, or simultaneous, responsive actuation of the slapper units which are connected to the spider array. I have avoided this problem by providing a singular bracket that I term a "branched bar" comprised of thin, flexible material, such as aluminum or polycarbonate plastic, and having the shape of a double beamed cross or asymmetrical H, i.e. an H with one lateral shorter than the other. Proximate the tips of the H legs are located a single orifice, of a general elliptical shape. It is my improvement that the modified ends of player unit underboard levers be adapted for either direct connection to the orifices (i.e., drop-in extensions) or linking thereto by connecting an eyelet of the lever to the orifice of a bar portion with a relatively stiff coil spring or a nonresilient cord element.

In an alternate embodiment of the present invention, the operational motion (and range of motion) of each player unit is improved by pivotally linking each bar portion of the branched bar to an associated one of the player unit underboard levers with a rigid bar. In order to limit the relative operational movement of the branched bar and the rigid bars coupled thereto, a stop member may be mounted on at least one of the rigid bars and/or on at least one of the forwardly-directed leg members of the branched bar.

The branched bar is connected to the transverse underside center board of the game board with a biasing element such as a spring. Upon the outwardly-directed actuation of an operator manipulated handle, the biasing element is stretched, thereby exerting an inwardly-directed force against the branched bar which, when the handle is subsequently released, may rapidly propel the branched bar against the center board. Unfortunately, such an impact may damage various components of the game or, in the very least, result in the undesirable vibration or bouncing of the player units coupled to the branched bar. This deleterious impacting is advantageously reduced by interposing a cushioning element, composed of a sponge-type material or the like, between the center board and each branched bar.

The present invention provides an improved deflector (hereafter referred to as a "dual deflector") which is adapted to more accurately deflect a playing ball toward the mouth of an opponents goal. Previously, I developed a wedge-shaped deflector having an actuate portion for redirecting a playing ball moving "up-rink" back toward the intended goal and a planar ramp portion for inwardly deflecting a playing ball moving toward an opponents side of the game board in the general direction of the opponent's goal. Unfortunately, due to the planar geometry of the ramp portion, the angle of impact of the playing ball thereagainst must be accurately controlled in order to deflect the playing ball directly into the mouth of the opponents goal. As such, I have improved the deflecting action of the wedge-shaped deflector by redesigning the ramp portion to include a concave portion interposed between two planar portions, wherein the playing ball will be accurately deflected by the ramp portion of the dual deflector toward the mouth of the opponent's goal, regardless of the angle of impact thereagainst. Advantageously, the arcuate and ramp portions of the dual deflector are adapted to redirect or deflect a playing ball in approximately the same direction and along substantially the same path toward the mouth of the opponent's goal.

In my previous disclosures, I have provided at least one offensive off-side (remote) player unit proximate an opponent's goal. In the present invention, I have positioned an off-side offensive player unit (controlled by a first operator) and a defensive player unit (controlled by an opposing operator) directly behind each goal to more accurately simulate the "behind the goal" action commonly encountered in the game of hockey. Further, I have designed a unique, adjustable system for coupling the off-side offensive player unit (disposed behind a first goal) and the corresponding defensive player unit (disposed behind a second, opposing goal) to the branched bar of each operator, thereby allowing the simultaneous actuation of the player units on each team. By positioning the offensive off-side player unit directly behind the opponent's goal, the operator thereof is able to more easily pass or shoot the playing ball "up-rink" along the rink wall to the dual deflector, where it is subsequently redirected toward the opponent's goal by the arcuate portion of the deflector. To prevent any damaging interaction or contact between the off-side offensive and defensive player units disposed behind each goal and to limit the rotation thereof, a unique triangular stop member is positioned therebetween. Further, in their quiescent state, the off-side offensive and defensive player units are biased against opposing sides of the triangular stop member by appropriately positioned underboard springs.

The present invention utilizes a pair of unique, rotatable, multidirectional, height-adjustable serving mechanisms, each mounted upon one of the dual deflectors, for introducing the playing ball onto the playing surface of the game board. In particular, each serving mechanism incorporates an L-shaped segment of hollow tubing which is adapted to receive the playing ball therethrough. Preferably, the upper arm of each segment of the hollow tubing extends through an aperture in a positioning plate which has been suitably mounted to an upper portion of the rink wall, above each dual deflector; the lower arm of each segment of hollow tubing resting upon the upper surface of a deflector. To serve a playing ball onto the playing surface, a player simply drops the ball into the upper end of the hollow tubing after rotating the serving mechanism to the desired serving position. Oftentimes, it is desirable to augment the serving velocity of the playing ball to quickly "pass" the playing ball to a specific player unit or to otherwise enliven game play. To this end, one or more successive vertical, tubular extension members may be removably interconnected to the upper end of the L-shaped serving mechanism in order to increase the vertical displacement and resultant serving velocity of a playing ball.

I shall hereinafter describe my improvements in greater detail having reference therein to the following drawings.

BRIEF DESCRIPTION OF THE DRAWINGS

Of the drawings:

FIG. 5A is a spring-biased slapper unit showing the spring detail;

FIG. 5B is an alternate embodiment of a FIG. 4 slapper unit;

FIG. 6B is a perspective of a FIG. 6A deflector in relation to an improved goalie cage;

FIG. 7A is a top plan of the improved goalie catchment mechanism;

FIG. 7B is a perspective view of the FIG. 7A unit;

DETAILED DESCRIPTION OF THE INVENTION

Figure 1:
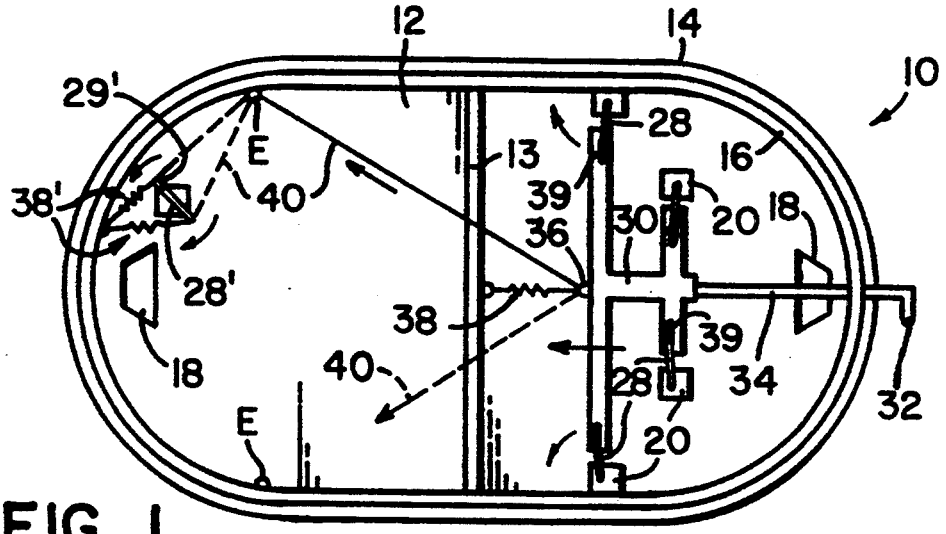
FIG. 1 is a bottom plan schematic of the game board featuring the details of a single (right) playing mechanism.

Referring to the drawings, particularly FIG. 1, there is depicted a bottom plan of my game 10. The game board or game table is comprised of a floor 12 parametrically surrounded by a rink wall 14 and a base 16. Dividing the board between the two goal portions is a center board 13 which is utilized for both support of the floor 12, for general reinforcement and for mounting apparatus thereonto. Proximate each end of the floor 12 are located trapezoidal or triangular (not shown) holes 18 which are used as drop-through wells for the playing object, as well as the passage therethrough of goalie apparatus. Journaling blocks 20 are used to mount the player 22 unit (slappers) and may be inserted into the board 12 (see FIG. 4) or merely fixed to the underside thereof as in my initial disclosure (see Related Disclosures). Shown in FIG. 1 are the actuating lever arms 28 as they project below the journaling blocks 20 and connected to branched bar 30 receptive orifices 39. The branched bar 30 is used to gang two or more of a team's player units for near-simultaneous movement when a game operator manipulates handle 32 which is connected by extension 34 to the branched bar 30 proper. The connection of levers 28 to the branched bar 30 will be taken up later in this disclosure. Continuing with the FIG. 1 disclosure, tying element 36 on the downfield portion of the branched bar 30 is used to connect it to a spring element 38 and thence, to the center board 13. At least one cushioning element 78 (see FIG. 12) may be suitably affixed on each opposing side of the bisecting center board 13 to prevent each branched bar 30 from impacting thereagainst. A flexible, nonstretchable wire 40 is passed from tying element 36 of the branched bar 30, through the center board 13 to an eyelet E or similar device which allows it to be drawn to an off-side player (remote) lever by one route, or an alternate, and tied to a lever eyelet 29'. The alternating form of hookup just described allows an off-side player to be rotated clockwise or counterclockwise in its striking action, whichever action is desired by the branched bar 30 operator. Springs 38' are used to bias the remote lever arm 28' according to the desired return position of the mode selected for operation.

Figure 2:
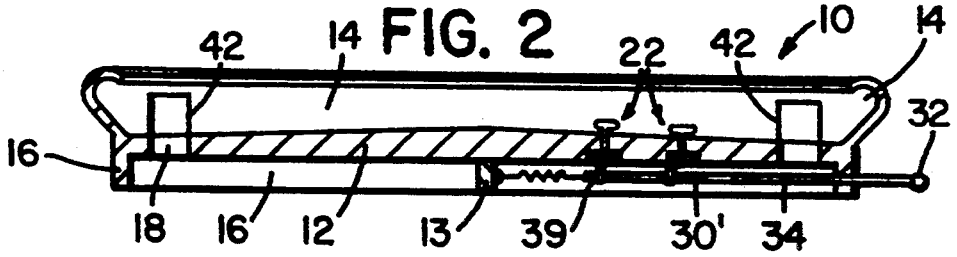
FIG. 2 is a side elevation of the FIG. 1 game board in cross section.

FIG. 2 is a partial elevational view of the FIG. 1 apparatus presented in cross section. This view clearly points out the distinctive features of the rink wall 14 in contrast to my original disclosure and the cited relevant art. As will be discussed hereinafter, the distinctive feature of this arcuate rink wall, one that clearly defines it over the relevant art, is the recurve portion that is used to direct a peripherally traveling ball back onto the board, often times altering the direction but not the momentum of such a playing object. The mechanism at the right hand side discloses the branched bar 30 in partial cross section 30'. Here it may be seen that downward extensions 29 of the lever arms for players 22 engage the branched bar 30 legs at orifices 39. The engagement is a simple drop-in connection which, because of the shape of the orifices 39 as elliptical slots, assures sufficient "slack" as the reciprocating branched bar 30 motivates the levers 28 through essentially arcuate movements as depicted in FIG. 1.

Figure 3:
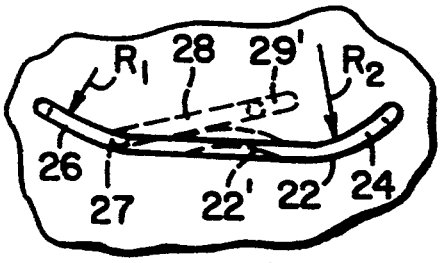
FIG. 3 is a top plan of an arcuate slapper (player) unit.

The top plan of FIG. 3 discloses my new arcuate or curvate slapper 22 design. From the vertical post 27 (phantom), the stick emulating slapper arm 22 extends, cantilevered and parallel to the board 12, in an arcuate or sinuous 22' manner. A radiused ($R_2$) portion 24 is designed to releasably capture a ball. A glove emulating portion 26 of the slapper extends out from the post 27 opposite the slapper arm 22 and is in fact coextensive in design. The glove emulator 26 is also curvate having a radius ($R_1$) which may or may not be the same as slapper end 24. The actuating lever 28, its depending shaft 29 and alternate hook feature 29' are shown in phantom with much clearer detail presented below.

Figure 4:
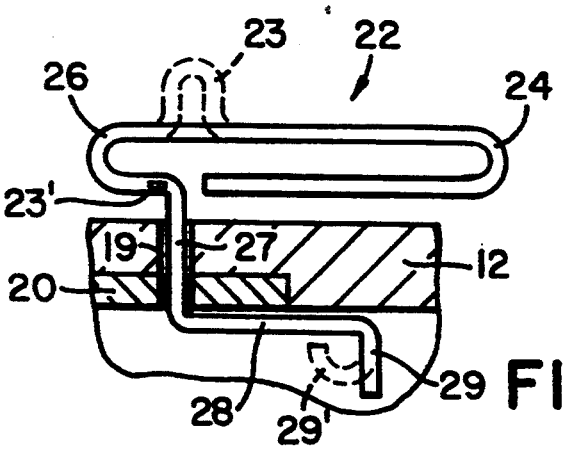
FIG. 4 is a side elevation of the FIG. 3 unit showing alternate connection mechanism on the lower lever arm.
Figure 10:
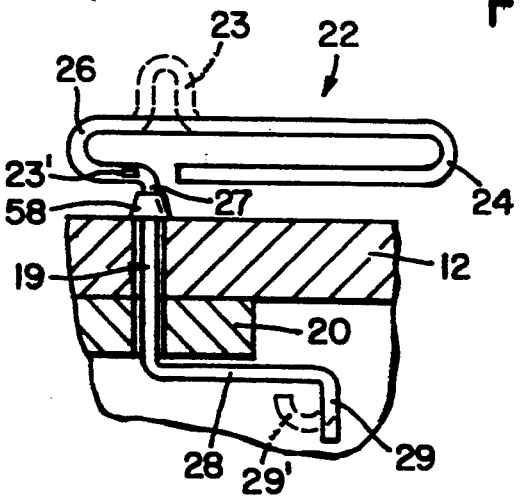
FIG. 10 is a side elevation of an alternate embodiment of the slapper (player) unit illustrated in FIG. 4.

FIG. 4 is a side elevation of the FIG. 3 mechanism showing, in detail, some alternate embodiments for creating a more easily produced apparatus. Inherent in this depiction is the concept of vertical post-lever arms production independent of the slapper arms 22. The vertical post-levers 28 are journaled in journaling block 20 and inserted into recesses of the board 12, or simply fixed adhesively under the board so that the vertical post 27 will communicate with the upper board through holes 19. Advantageously, lever 28 is oriented at a ninety-degree angle relative to vertical post 27 and extends directly under board 12, thereby limiting the vertical operational displacement of the slapper unit 22. Additionally, the levers 28 are either bent into an eyelet 29' or essentially at right angles to depend downward, creating branched bar 30 orifice 39 engaging shafts 29. Suitable known means 23' are then used to connect the slapper unit 22 to the vertical post 27 above the board. Additional to the previously described apparatus is the use of vertical extension 23 on the slapper arm 22. This nuance, although providing no additional mechanism for contact with a playing object, is suitable for the placement thereon of indicia useful in the identification of player teams. As further illustrated in FIG. 10, hole 19 may be extended (necessitating the elongation of vertical post 27) by securing the journaling block 20 directly to the underside of the board 12, thereby substantially reducing the operational "tilting" of the vertical post 27. Further, a collar 58, composed of plastic or other suitable material, may be provided to prevent the slapper unit 22 from coming into contact with the upper surface of the board 12. As shown in FIG. 10, the collar 58 is adapted to receive the vertical post 27 therethrough.

Referring jointly to FIGS. 5A and 5B, a slightly different slapper mechanism, with spring-biasing, is shown as a singular slapper 22' having (primed) parts similar to those previously discussed in FIGS. 3 and 4. The distinctive feature of the FIG. 5B article is the straight vertical post 27' having no lever projecting therefrom. Instead, slapper 22' has an eyelet 25 fixed at the end of slapper arm 24'. To this eyelet is connected a cord and spring mechanism 21' which is attachable at several portions on the board such as the goalie cage 42 or the top edge of the rink wall. It is the purpose of this unit to be inserted in the playing board 12 at several locations (to be provided by the manufacture according to the published rules and method of play) so that special "shots" may be taken by one or more of the game operators. An example of such is the central location over the center board 13 for the taking of a "penalty shot" by one of the operators. As an alternative to the spring-biasing mechanism 21', I employ another spring-biasing mechanism 21 as depicted in FIG. 5A. Wherever the holes 19 are located for this embodiment, two holes 19L–19R, of much smaller diameter, are placed straddling the hole 19 which is used for mounting therein vertical post 27'. In FIG. 5A it may be seen that one portion of the small coil spring 21 is affixed on (not shown) or into the post 27', while an opposite end, that has been bent so that is substantially downward and parallel to the vertical post center line (see CL), is set into either hole 19L or 19R. This biasing modality allows the slapper 22' to be set into the hole 19 while orienting its final position toward the direction of desired travel of the "shot" by setting the downward extension of spring 21 into the left or right hole 19L or 19R. Thereafter, the player makes a winding turn W to "cock" the slapper arm 22', places an object of play at the radiused portion $R_2$ (see FIG. 3) and, upon releasing the arm (whether or not afforded eyelet or tab 25) causes the object of play to be propelled in the preplanned direction. As a further means of example, the reader might consider the direction or path of travel D as depicted hereinafter with the discussion of FIG. 6B.

Figure 6A:
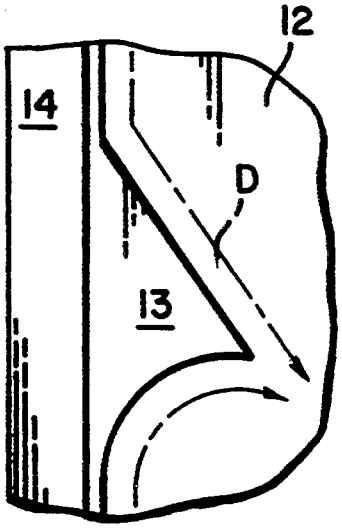
FIG. 6A is a top plan of a deflector unit located along the base of the rink wall.

Referring first to FIG. 6A, I have presented a top plan of a deflector 13 which resides generally at the left side of the field, conterminous with the rink wall 14, so that the arcuate portion depicted therein faces a defending goal. In the original disclosure of my game, I explained how the arcuate portion of deflector 13 would return the object of play toward the goal at whose left side it was positioned. Further, a ramp portion of this deflector will deflect a "shot" in the direction D as indicated (note: towards the proximate, "defending" goal); a distinction over prior art. Reference to FIG. 6B clearly depicts how the "shot" D moves along the planar face 13' of the deflector 13, also toward "defending" goal 18. The reader will note that the rink wall 14 is shown with arcuate detail and the only vertical planar portions are the deflector ramp 13' and the triangular shaped goalie cage 42. I have found the triangular shaped goalie cage, that is, a shallow V form to be an improvement over my original device. Also, as mentioned earlier, taking advantage of this ramp or angular shaped deflection surface 13', allows one much greater versatility in making a "penalty shot" using the apparatus of FIGS. 5A and/or 5B.

Figure 11B:
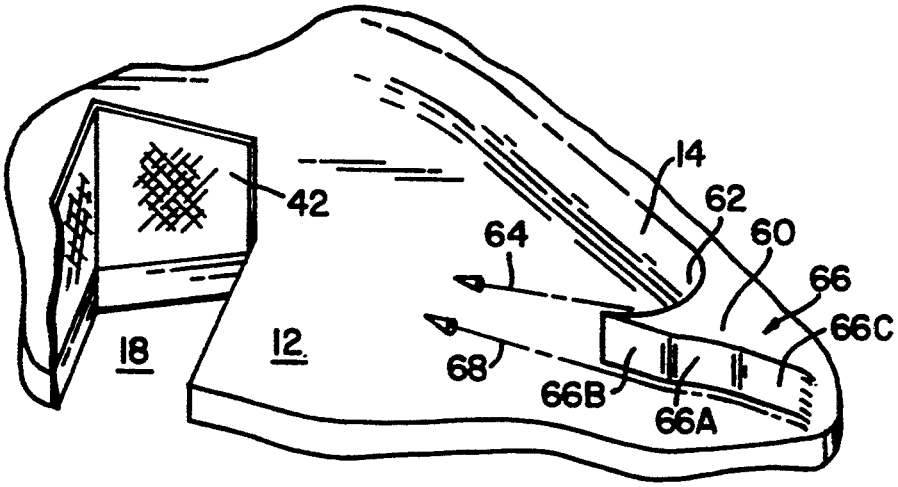
FIG. 11B is a perspective view of the FIG. 11A deflector.
Figure 11A:
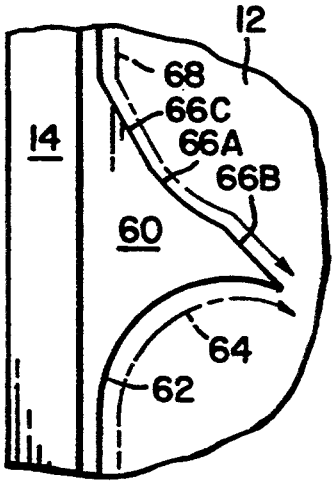
FIG. 11A is a top plan of an alternate deflector unit.

An alternate embodiment of a deflector 60, which is adapted to more accurately deflect a playing ball toward an associated goal 18, is presented in FIGS. 11A and 11B. Again, as in the previous embodiments of my slapball game, the arcuate portion 62 of deflector 60 would return a playing ball toward the goal at whose left side it was positioned as indicated by dotted line 64. Further, the ramp portion 66 of deflector 60 will deflect a "shot" in the direction indicated by dotted line 68. Unlike my previous deflector designs, however, deflector 60 includes a concave portion 66A interposed between planar portions 66B, 66C. Advantageously, the planar-concave-planar configuration of ramp portion 66 serves to more accurately "guide" a playing ball toward an associated goal 18, substantially independently of the angle of impact of the playing ball thereagainst.

Along with the goalie cage 42 modification, I have improved the goalie device considerably. To the goalie bracket 50, I place (at the end thereof), a catchment device comprising a ribbonous strip of generally inflexible material shaped, at the center 52 thereof, in the form a shallow U and, at the left and right ends of the shallow U and concatenated thereto, two asymmetrical, shallow V portions 54L and 54R. These give the overall device the shape of a stylized W and effects a releasable catchment device, the center 52 of which emulates a goalie's stick and skates while the V shaped ends 54L and 54R emulate stick and gloves. FIG. 7B shows the goalie catchment device in perspective.

Figure 8:
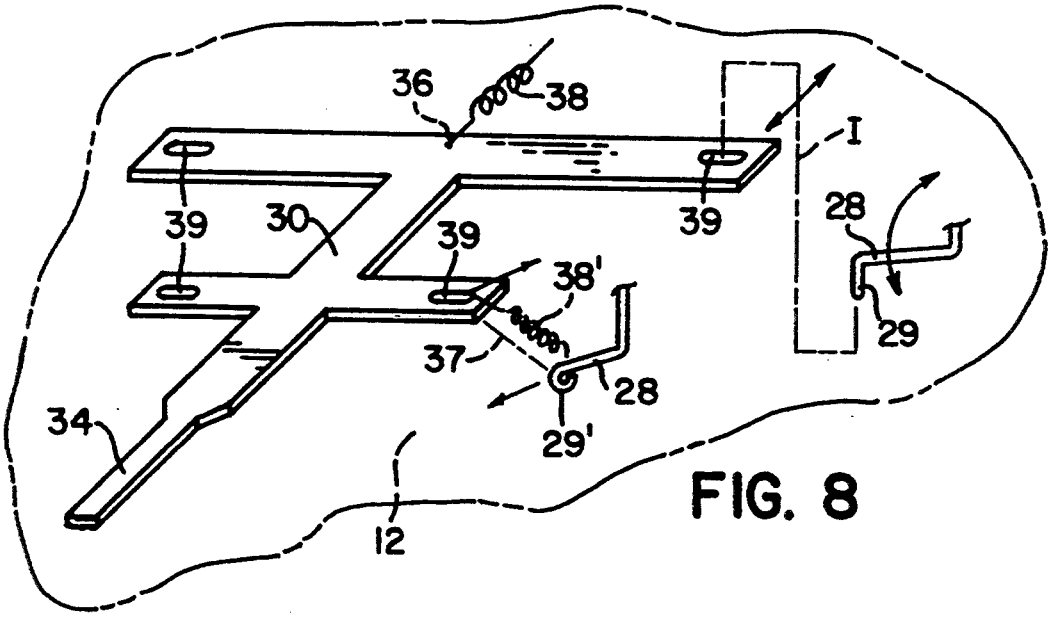
FIG. 8 is a perspective detail of the branched bar with variable slapper engagements.

Referring more particularly now to FIG. 8, the branched bar 30 is shown with its connection to the levers 28 of the various slapper units. As may be seen from this assembly perspective, the connective portions of the branched bar are the elliptical orifices 39 at the ends of the asymmetrical H leg members or bar legs. As may be seen through the underside of the board 12, the branched bar 30 is secured by extension 34 and by the spring-biasing mechanism 36, 38. The various levers 28 are afforded either eyelet 29' or downwardly depending shank 29 ends. The shank 29 is simply dropped into orifice 39 where, upon actuation of the branched bar 30, it finds sufficient latitude for movement to allow the arcuate movement shown without any binding between the shank 29 and the orifice 39. The insertion of shank 29 is indicated (I) while an alternate connection mechanism of eyelet 29' is depicted by the coupling symbol (right angled opposing arrows) signifying either cord 37 or spring 38' apparatus.

Figure 12:
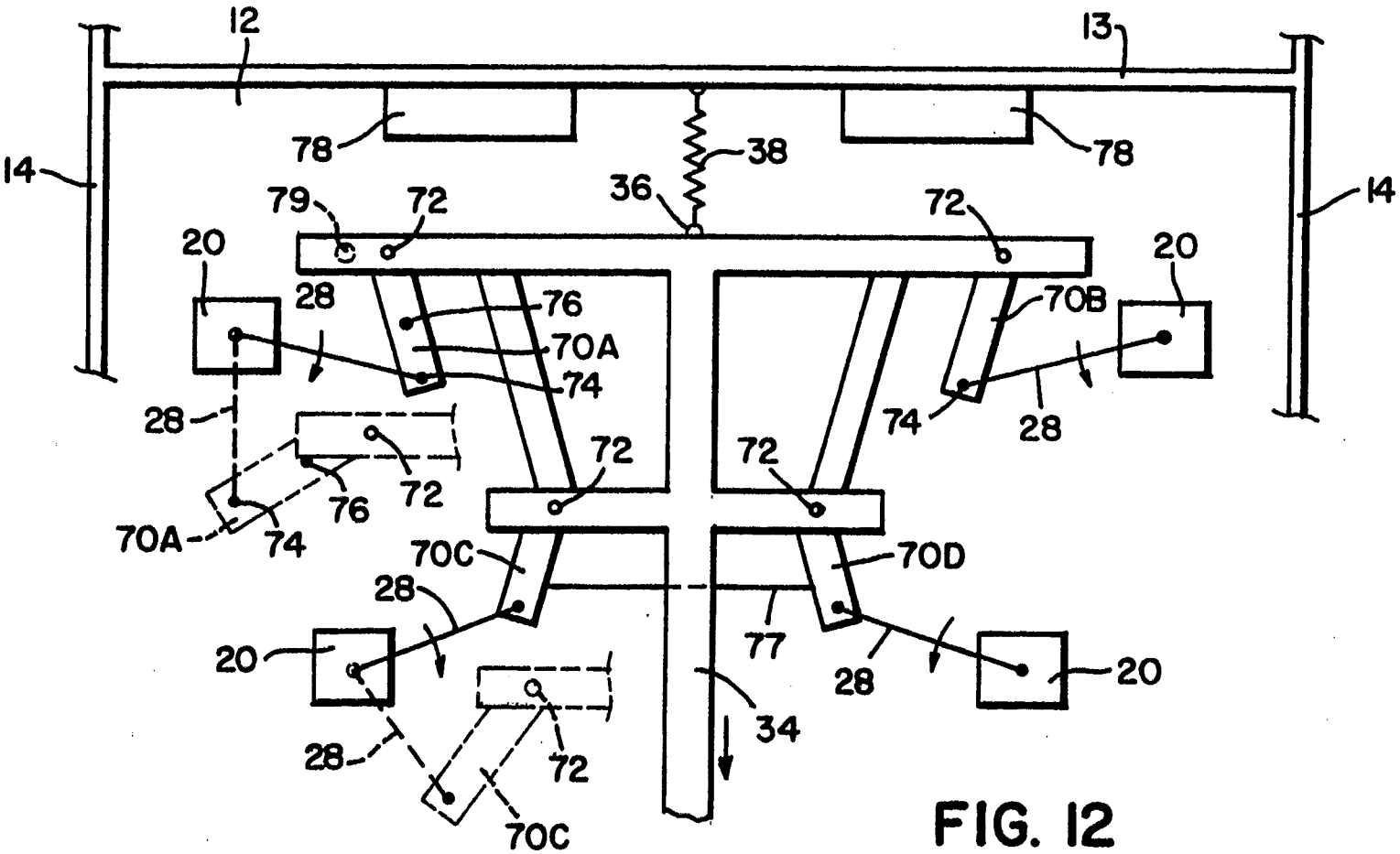
FIG. 12 illustrates an alternate embodiment of the branched bar.

An alternate embodiment of the branched bar 30 is illustrated in detail in FIG. 12. In particular, the asymmetrical H leg members of the branched bar 30 are pivotally secured to levers 28, in a spaced apart relationship, with rigid bar members 70A, 70B, 70C and 70D. Each leg member of the branched bar 30 includes an element 72 for pivotally connecting a first end portion of an associated rigid bar member thereto. Further, a suitably formed end section of each lever 28 is pivotally attached to a pivot element 74 disposed proximate a second, opposing end portion of an associated rigid bar member. As such, the relative copivoting interaction (illustrated in phantom) of each rigid bar-lever combination is adapted to provide an associated slapper unit with a substantial operational displacement. In order to limit the relative operational movement of the branched bar 30 and the rigid bars 70A–D, an upwardly-protruding stop member 76 may be mounted on rigid bar 70A and/or a downwardly-protruding stop member 79 (illustrated in phantom) may be mounted to the underside of a forwardly-directed leg member of the branched bar 30. A flexible, stretchable cord 77 may be utilized to couple the operational displacement of rigid bars 70C and 70D.

Figure 9:
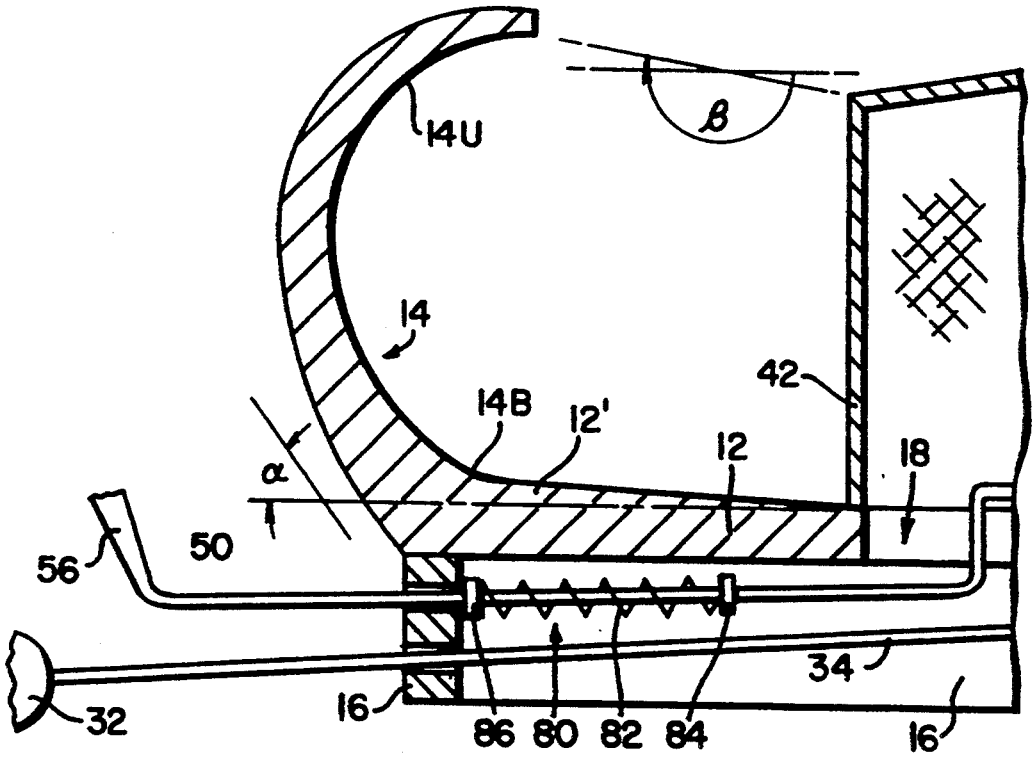
FIG. 9 is a cross-sectional elevation of the game board immediately behind a goalie cage.

FIG. 9 provides a detail, in cross sectional elevation, of my rink wall improvement. The plane of the board 12 is depicted with the angular change of 14B as $\alpha$, an angle of about 30°–40°. The wall then rises and recurves at 14U effecting a final recurve totaling at least 180° ($\beta$). The portion behind the goal cage 42 remains slightly elevated 12' to foreclose the possibility of a "stalled" ball or object of play behind the cage 42. Remaining apparatus not shown in the earlier figures is goalie bracket 50 and operator lever or handle 56.

As further illustrated in FIG. 9, goalie bracket 50 includes a spring arrangement 80 for forcefully ejecting a playing ball captured by an associated goalie (not shown-attached proximate a distal end of bracket 50) in a forward direction. In particular, spring arrangement 80 includes a spring element 82 for longitudinally enclosing a portion of bracket 50, a first attachment member 84 for fixedly securing a first end of the spring element to the bracket 50 and a second attachment member 86, attached to the opposing end portion of the spring element 82, for slidably receiving bracket 50 therethrough. When an operator applies an outwardly-directed force against the goalie bracket 50 via handle 56, attachment member 82 is displaced toward attachment member 84, thereby compressing the spring element 82 therebetween. Upon the operator actuated release of handle 56, spring element 82 is adapted to drive bracket 50 (and the goalie attached thereto) in a forward direction.

Figure 13:
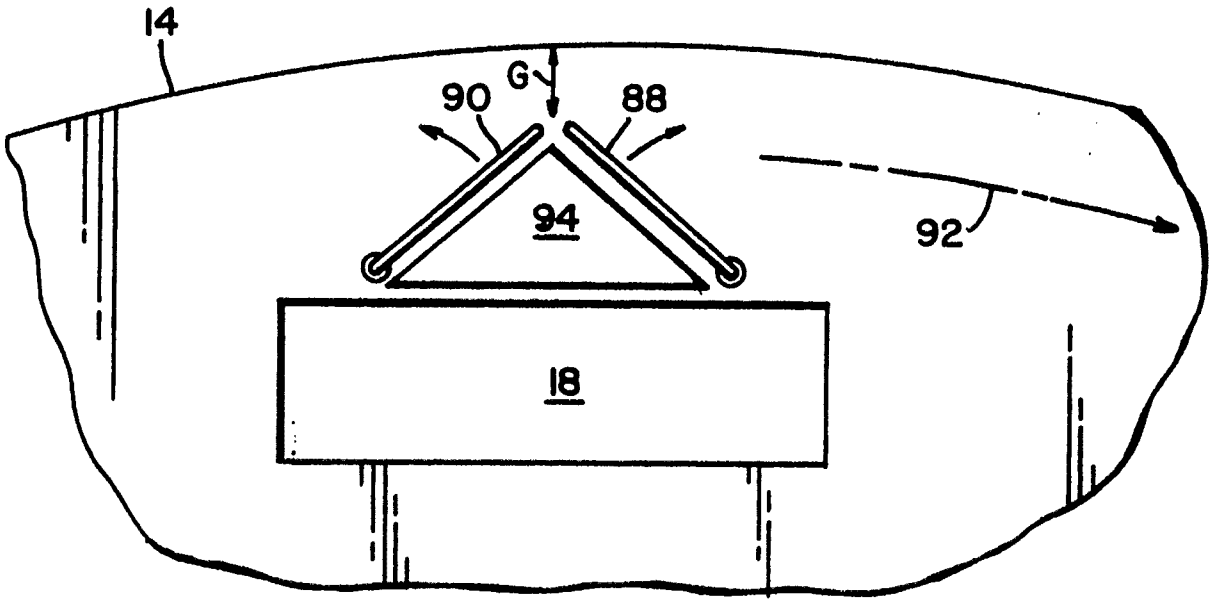
FIG. 13 illustrates the relative positioning of an offensive off-side player unit and associated defensive player unit behind each goal.

Referring now specifically to FIG. 13, I have provided an offensive off-side player unit 88 (controlled by a first operator) and an associated defensive player unit 90 (controlled by an opposing operator) directly behind each goal 18. In particular, offensive off-side player unit 88 is adapted to direct a playing ball along the left side of the rink along path 92 toward deflector (13 or 60), where it is subsequently redirected via the arcuate portion thereof toward goal 18. Similarly, defensive player unit 90 is adapted to direct a playing ball along the right side of the rink toward the goal of the first operator. A uniquely designed triangular stop member 94, disposed between the offensive off-side player unit 88 and the defensive player unit 90, is provided to prevent any damaging operational interaction or contact therebetween. It should be noted that a gap G exists between the end portions of the player units 88, 90 (when maintained in their quiescent state against the triangular stop member 94, as illustrated) and the rink wall 14, thereby permitting a playing ball to pass untouched therebetween.

Figure 14:
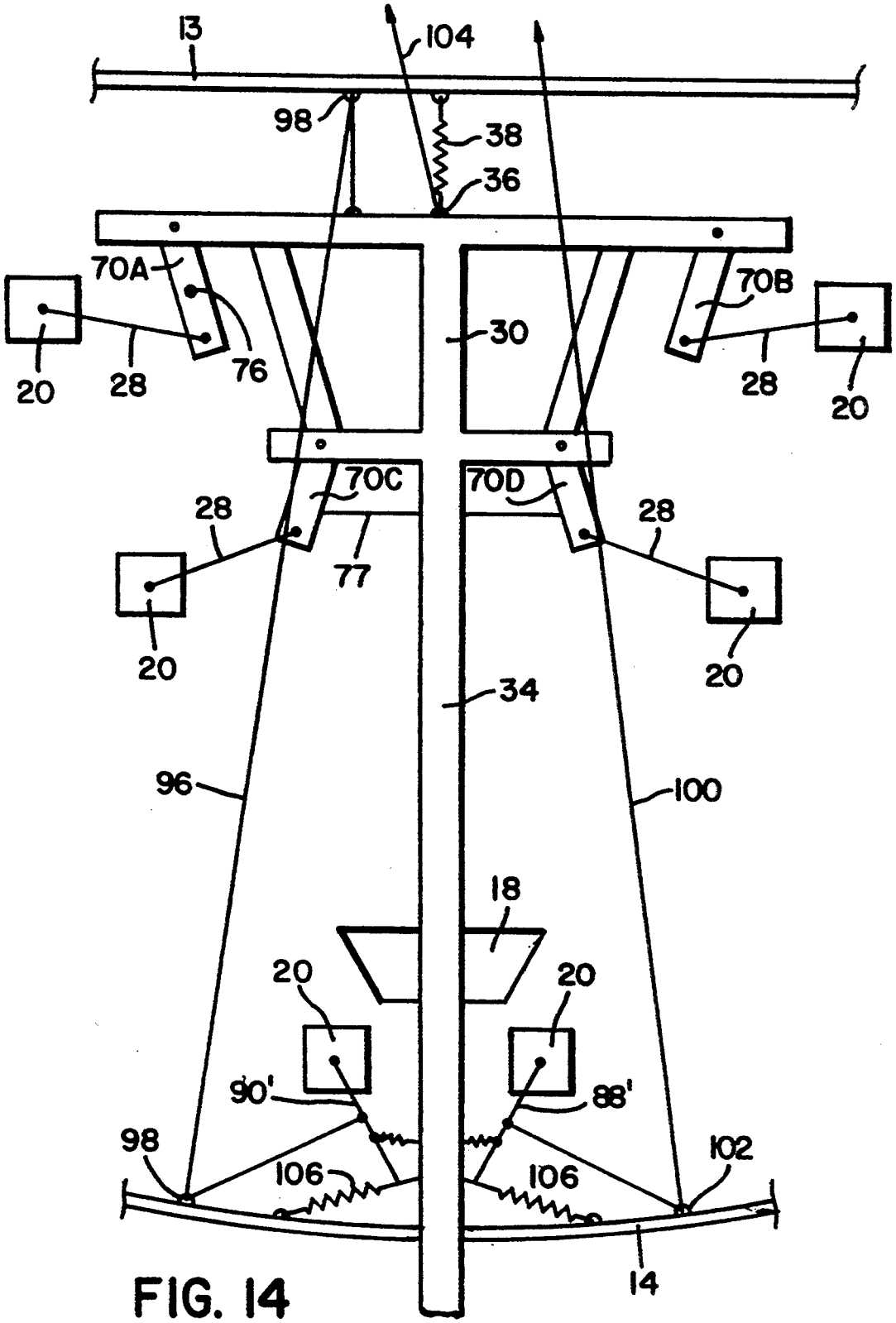
FIG. 14 is a further, more detailed illustration of the branched bar depicted in FIG. 12.

As illustrated in detail in FIG. 14, the offensive off-side player unit 88 and defensive player unit 90 are actuated in response to the operator manipulation of a corresponding branched bar 30. In particular, a flexible, nonstretchable cable 96, having a first end affixed to a defensive player unit lever 90' and a second, opposing end affixed to a forwardly-disposed arm of the branched bar 30, is provided to actuate defensive player 90 in response to a displacement of branched bar 30. Preferably, cable 96 is passed from the defensive player unit lever 90' to the branched bar 30 through suitably positioned eyelets 98. As illustrated, in response to the outwardly-directed displacement of the branched bar 30, defensive player unit lever 90' is adapted to rotate in a clockwise direction (the corresponding counter-clockwise rotation of player unit 90 is detailed in FIG. 13). Similarly, offensive off-side player unit lever 88' is coupled via a flexible, nonstretchable cable 100 and eyelet 102 to the forwardly-disposed branch of the opposing branched bar (not shown). Analogously, the oppositely disposed offensive off-side player unit (not shown), which is controlled by branched bar 30, is linked thereto by cable 104. Further, springs 106 are provided to bias the player units 88, 90 against the sides of the triangular stop member 94 (as illustrated in FIG. 13). Finally, each of the aforementioned cables may be appropriately shortened or lengthened in order to alter the operational velocity and range of motion of the player units coupled to a corresponding branched bar 30.

Figure 15:
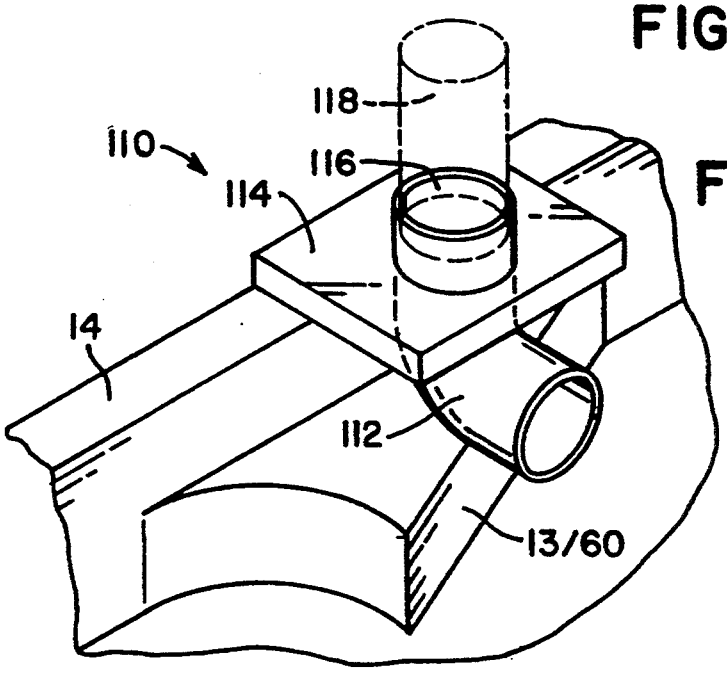
FIG. 15 is a perspective view of a rotatable, multidirectional, height-adjustable serving mechanism.

A novel, rotatable, multidirectional, height-adjustable serving mechanism, generally designated as 110, is illustrated in FIG. 15. In particular, the serving mechanism 110 includes an L-shaped segment 112 of hollow tubing for receiving a playing ball therethrough. A positioning plate 114, mounted to the rink wall 14, is provided for rotatably receiving the upper arm portion of the L-shaped segment 112 therein, with the lower arm portion of the segment 112 resting upon the upper surface of a deflector (13 or 60). To serve a playing ball onto the playing surface of the slapball hockey game of the present invention, a player simply drops the ball into the aperture 116 in the upper end of the L-shaped segment 112 of hollow tubing, after rotating the serving mechanism to the desired serving position. To increase the serving velocity of the playing ball, one or more vertical, tubular extension members 118 (illustrated in phantom) may be successively inserted into aperture 116.

Novel aspects of my original disclosure, such as the spring-biased goalie position, additional to separately operated goalies, capable of moving side to side as well as backward and forward, have not been belabored in this disclosure. What I have done is provided apparatus for a more challenging game that can readily incorporate innovations and modifications by the game operators. Such improvements and modifications are encouraged and will be readily generated by various operators as they become familiar with the use of my invention. It is my desire to allow as great a latitude as possible in the modification of my game consistent with the hereinafter appended claims.

What is claimed is:

1. A slapball game having two teams, each said team including a plurality of slapper units, each slapper unit having a ball engaging arm subtending a link arm through a vertical post means, each slapper unit pivotally mounted on an essentially oval board, said board peripherally enclosed by a wall and having a goal means proximate each of two arcuate ends thereof, an improvement comprising:

first and second movable goalies, wherein each of said goalies is located forwardly of an associated one of said goal means, said goalies each having a forward portion for releasably catching a playing ball;

first and second handle members, wherein each of said handle members is located proximate an opposite, arcuate end of said board and is attached to an associated one of said goalies by a connecting means, wherein by moving one of said handle members, an operator can move an associated goalie toward or away from the goal means and also in a side to side motion; and first and second spring means each operatively connected to an associated one of said goalies, wherein the spring means biases the associated goalie toward a forward position whereby when an operator pulls back on a handle member attached to a goalie, the spring means is compressed so that if the operator releases the handle member when the spring means is in a compressed condition, the spring means will snap back to its unstretched state thereby enabling an operator to cause a goalie that has a playing ball located within the forward portion thereof to forcefully eject the playing ball.

2. The slapball game according to claim 1 wherein each said spring means includes a spring element which is longitudinally secured about an associated one of said handle means, said spring means further including means for fixedly securing a first end of said spring element to a forwardly-extending portion of the associated handle means and means for slidably securing a second end of said spring element to a rearwardly-extending portion of the associated handle means.

3. The slapball game according to claim 1, further including:

a slapper linkage characterized by a singular, thin branched bar having a plurality of bar portions arranged in an asymmetrical H configuration for ganged linkage to the link arms of each said slapper unit, so that upon movement of the bar, all slapper units to which said bar is connected will simultaneously pivot; and a plurality of rigid connectors, each pivotally securing, in a spaced apart relationship, the link arm of each said slapper unit to a corresponding one of said bar portions.

4. The slapball game according to claim 1, wherein a first end portion of each said rigid connector is pivotally secured to the link arm of one of said slapper units, and wherein a second end portion of each said rigid connector is pivotally secured to one of said bar portions.

5. The slapball game according to claim 1 wherein at least one of said rigid connectors further includes a stop member for limiting the relative pivotal movement of the branched bar and the rigid connectors.

6. The slapball game according to claim 1, wherein said board further includes a transversely-bisecting center board thereunder, and cushioning means, disposed between said slapper linkage and said bisecting center board, for cushioning an operational impact of said slapper linkage thereagainst.

* * * * *